United States Patent [19]

Heiderer

[11] 4,024,790

[45] May 24, 1977

[54] BORE GAS EVACUATION DEVICE FOR CANNONS AND GUNS

[75] Inventor: Conrad Elmer Heiderer, Huntington Woods, Mich.

[73] Assignee: The United States of America as represented by the Secretary of the Army, Washington, D.C.

[22] Filed: Oct. 31, 1975

[21] Appl. No.: 627,579

[52] U.S. Cl. ..... 89/1 E; 89/14 B

[51] Int. Cl.[2] ..... F41F 17/12; F41F 17/14

[58] Field of Search ..... 89/1 E, 14 A, 14 B, 89/14 C, 14 E; 60/239, 418, 269

[56] References Cited

UNITED STATES PATENTS

| | | | |
|---|---|---|---|
| 1,502,558 | 7/1924 | Galliot | 89/14 C |
| 1,551,617 | 9/1925 | Pöhlmann | 89/14 A |
| 1,994,458 | 3/1935 | Barnes | 89/14 C |
| 2,052,869 | 9/1936 | Coanda | 239/418 |
| 2,351,037 | 6/1944 | Green | 89/14 E |
| 2,447,205 | 8/1948 | Powell | 89/14 C X |
| 2,766,661 | 10/1956 | Margulis | 89/14 A X |
| 2,791,940 | 5/1957 | Speake et al. | 89/1 E |
| 2,807,986 | 10/1957 | Howard et al. | 89/1 E |
| 2,872,848 | 2/1959 | Schuessler | 89/14 C |
| 3,261,162 | 7/1966 | Coanda | 60/239 |

FOREIGN PATENTS OR APPLICATIONS

| | | | |
|---|---|---|---|
| 332,849 | 9/1958 | Switzerland | 89/14 C |

*Primary Examiner*—David H. Brown

*Attorney, Agent, or Firm*—Nathan Edelberg; Harold H. Card, Jr.; Robert O. Richardson

[57] ABSTRACT

A bore gas evacuation system for large and small caliber guns, especially when used in combat vehicles, and employing apparatus carried by the gun barrel and constructed to utilize the Coanda effect to enhance flow of ambient air through the barrel.

3 Claims, 1 Drawing Figure

BORE GAS EVACUATION DEVICE FOR CANNONS AND GUNS

GOVERNMENT RIGHTS

The invention described herein may be manufactured and/or used by or for Government for governmental purposes without the payment of any royalty thereon.

BACKGROUND OF INVENTION

Large and small caliber guns used in combat vehicles present considerable problems in the harmful effects on personnel of propellant gases expelled from the open breech or receiver into the interior of the vehicle during firing of the weapon.

Prior art methods employed to overcome these effects include systems relying on the direct application of a portion of the propellant gases to clear the bore of propellant gases through the muzzle. In one such system, valves control flow of a portion of propellant gases through holes in the gun barrel into and out of an accumulator which are used to expell propellant gases through the muzzle. Sequencing of the valve operation is pressure actuated presenting considerable design problems.

In another type prior art bore evacuation system, an external source of auxiliary ejection gas is employed which also involves direct application of the ejection gas to the propellant gases. In this system, the breech must be opened before the ejection gas can be introduced into the bore thereby permitting some evacuation of propellant gases through the breech. These types of systems are thus particularly not suitable for automatic weapons because of manufacturing design problems and vehicle interior space limitations.

SUMMARY OF THE INVENTION

These and other problems, difficulties and disadvantages of the prior art are substantially overcome by utilization of the present invention involving a gas bore evacuation system for both large and small caliber weapon systems, including automatic weapon systems. The evacuation system comprises apparatus having a source of ejection gas which may be either a portion of the propellant gases or an auxiliary source of gas communicating downstream of the throat of a parabolically flared nozzle device axially aligned in the bore of the barrel of the weapon. When the pressure of the source ejection gas is greater than the pressure of the propellant gases throughout the bore, particularily in the throat area of the parabolic nozzle, the ejection gases from the source are first aspirated through an annular slot into the throat area by the propellant gases flowing through the muzzle end of the barrel creating in the nozzle area the physical conditions necessary to produce the Coanda effect set forth in U.S. Pat. No. 3,261,162, the disclosure of which is hereby incorporated by reference. When the breech or receiver is opened, air, at ambient pressure, is drawn into the bore by the combined effect of the aspirated ejection gases and propellant gases flowing toward the muzzle under the influence of the Coanda effect. The ambient air thereby clears the bore of propellant gases and not only evacuates the bore but also minimizes erosion and has an increased cooling effect on the gun barrel. The volume of ejection gas required in the operation of the system of the present invention is substantially less than that required with prior art systems. Holes need not be drilled in the gun barrel. Component requirements are reduced to a minimum. The operation of the system of the present invention is independent of the time cycling of the recoiling components of the gun. Adaption of the apparatus to existing weapon systems, including automatic weapons, is relatively simple and easy to apply. In this regard, the existing design of the breech or receiver components is unaffected. In addition, the apparatus of the present invention performs a gas flash suppression function by minimizing gas buildup adjacent the muzzle of the gun.

BRIEF DESCRIPTION OF THE DRAWING

These and other features, objects, and advantages of the present invention will become readily apparent to one skilled in the art from a reading of the following description of a preferred embodiment of the present invention when considered in conjunction with the accompanying drawing, wherein.

DESCRIPTION OF A PREFERRED EMBODIMENT

Figure 1:
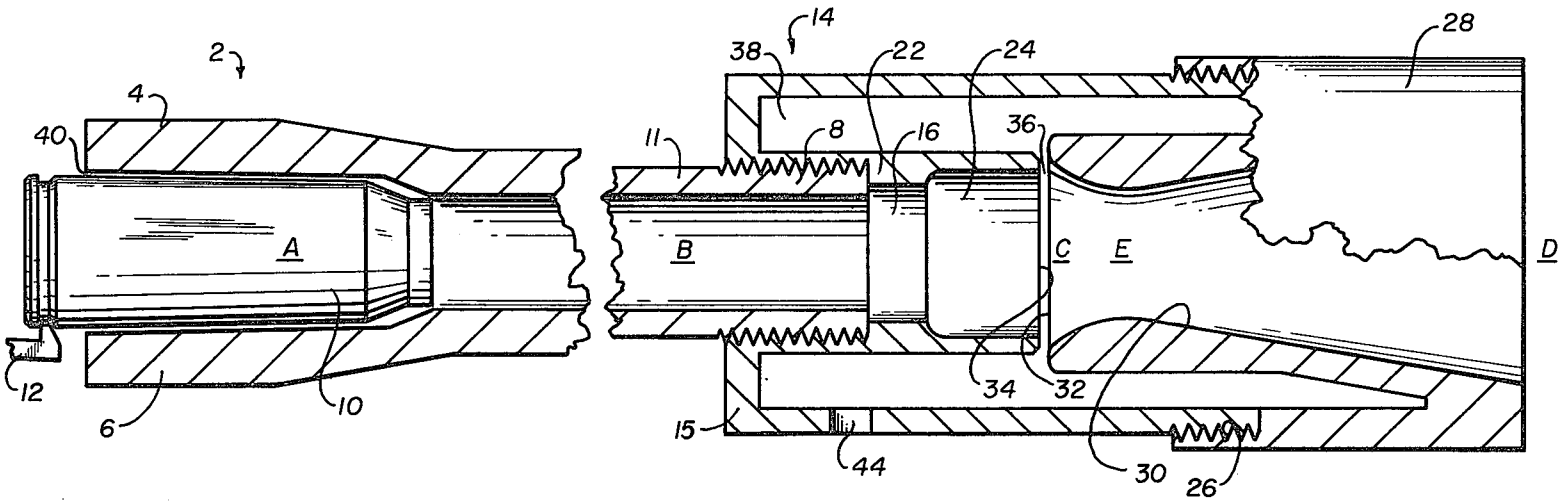
FIG. 1 is a fragmentary side view in section illustrating a gun tube or barrel of a weapon system incorporating apparatus constructed in accordance with the present invention.

In the drawing, FIG. 1 illustrates, schematically in cross section with parts broken away, a weapon system, generally indicated by the numeral 2 capable of being mounted in a combat vehicle (not shown) with a gun barrel 4 having its breech or receiver 6 in the interior of the vehicle and its muzzle end 8 exterior of the vehicle.

In the receiver 6 is shown a cartridge casing 10 communicating with the gun bore 11 and a casing extractor 12 is also partially shown.

The foregoing description relates to a conventional weapon system.

In accordance with the present invention, an annular two section housing, generally indicated by the numeral 14, is threaded on the muzzle end 8 of the barrel 4. The housing section 15 has an axial bore 16 corresponding to the bore of the barrel 4 to permit passage of a projectile. The bore 16 is formed in a projection 22 which has an enlarged opening 24. Threaded as at 26 to the housing section 15 is an end section 28 of the housing 14. The section 28 is provided with an internal flared parabolic nozzle 30 constructed in accordance with the teaching of the aforementioned Coanda patent. The housing section 28 is threaded so that there is defined between the end wall 32 thereof and the end wall 34 of the first housing section projection 22 an annular Coanda slot 36 which extends perpendicular to the longitudinal axis of the bore 16 and which communicates the bore 16 with an annular gas accumulator chamber 38. Chamber 38 is concentric with the bore 16 and is defined by the two sections of housing 14.

In operation, an unfired cartridge is inserted in the receiver or breech 6 and fired in any conventional manner. The expanding gas forces the projectile out the muzzle end of the gun barrel as at area D. A portion of the expanding pressurized propellant gas is also forced through the annular Coanda slot 36 and into the accumulator chamber 38, after the projectile leaves the bore 11. As pressure reduces in area C adjacent slot 36 by the expansion of gases in the area D, after the projectile leaves the bore 11, the spent cartridge case 10 is extracted from the receiver by the extractor 12. During extraction of the casing 10, an annular air passage-way 40 is provided for flow of ambient air into the gun bore 11 in area A to displace propellant gases in the direction of areas C and D.

Because of the Coanda effect, the pressure in the bore 11 will be lowest in the throat area E of the nozzle 30. The collected or stored gas in the accumulator chamber 38 then exhausts or aspirates through the Coanda slot 36 in the area C and moves in the nozzle through areas E–D and out of the gun barrel. The movement of the accumulated gas through slot 36 and nozzle 30 entrains ambient air moving from area A in the direction of area D and thus aspirates this air to clean the bore 11 of propellant gases.

If desired, pressurized gas can be supplied to the accumulator chamber 38 from an auxiliary source through a port 44. When not used, port 44 is plugged.

It will be appreciated that the flow of air through the bore not only cleans the bore but also reduces flash by the inherent action of the present invention preventing buildup of unburned gases and propellant in the muzzle area D. The flow of air also has a cooling effect on the gun barrel and associated parts.

It is understood that, although a preferred embodiment of the present invention has been shown and described herein, the present invention is not to be limited thereto, because variations and other embodiments thereof will become readily apparent to one skilled in the art from the foregoing description. Accordingly the present invention should be considered as limited only by the following claims.

I claim:

1. In a weapon system having a receiver and gun barrel, the improvement comprising a bore gas evacuation system including an axially bored housing attached to the muzzle end of the gun barrel, a gas accumulator chamber in said housing, said housing having an internal projection with an axial bore therein communicating with the bore of the gun barrel and opening into an enlarged end recess, said end recess terminating in an end wall defining one side of a Coanda slot, a nozzle member in said housing having an end wall defining the other side of said Coanda slot, the interior of said nozzle including a converging parabolic section located adjacent said Coanda slot, and a divergent section separated from said converging section by a throat section, whereby when said receiver is opened, air at ambient pressure is drawn into said gun barrel by the combined effect of the aspirated ejection gases and propellant gases flowing toward said muzzle under the influence of the Coanda effect.

2. The improvement of claim 1 wherein said housing is a two sectioned housing with a first section being mounted to the gun barrel and the second section being carried by the first section.

3. The improvement in claim 1 wherein said accumulator includes an extra source of pressurized gas.

* * * * *